US009180598B2

(12) United States Patent
Van Der Meer

(10) Patent No.: US 9,180,598 B2
(45) Date of Patent: Nov. 10, 2015

(54) SHAVER WITH HINGE BETWEEN HOUSING AND SHAVER HEAD

(75) Inventor: Mattheus Jacobus Van Der Meer, Drachten (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 457 days.

(21) Appl. No.: 11/720,179

(22) PCT Filed: Nov. 23, 2005

(86) PCT No.: PCT/IB2005/053881

§ 371 (c)(1), (2), (4) Date: May 24, 2007

(87) PCT Pub. No.: WO2006/056950

PCT Pub. Date: Jun. 1, 2006

(65) Prior Publication Data

US 2008/0092393 A1 Apr. 24, 2008

(30) Foreign Application Priority Data

Nov. 29, 2004 (EP) ..... 04106152

(51) Int. Cl.
*B26B 19/14* (2006.01)

(52) U.S. Cl.
CPC ..... *B26B 19/146* (2013.01); *B26B 19/14* (2013.01)

(58) Field of Classification Search
CPC .... B25B 19/14; B25B 19/143; B25B 19/145; B25B 19/146
USPC ..... 30/43.1, 43.6, 43.4, 43.5
See application file for complete search history.

(56) References Cited

U.S. PATENT DOCUMENTS

| | | | | | |
|---|---|---|---|---|---|
| 2,194,815 | A | * | 3/1940 | Testi | 30/43.1 |
| 2,748,470 | A | * | 6/1956 | Borden | 30/531 |
| 3,797,109 | A | * | 3/1974 | Yamada et al. | 30/43.1 |
| 4,688,329 | A | | 8/1987 | Oord | |
| 5,007,168 | A | | 4/1991 | Messinger et al. | |
| D331,642 | S | * | 12/1992 | DiGiovanni | D28/50 |
| 5,313,704 | A | * | 5/1994 | Atsumi et al. | 30/43.6 |
| 6,301,786 | B1 | | 10/2001 | Oswald et al. | |
| 6,354,005 | B1 | | 3/2002 | Bosch | |
| 6,647,626 | B2 | * | 11/2003 | Nakano | 30/43.4 |
| 2005/0172491 | A1 | * | 8/2005 | Beugels | 30/43.6 |

FOREIGN PATENT DOCUMENTS

| | | | |
|---|---|---|---|
| EP | 0543460 | | 5/1993 |
| EP | 721826 | | 7/1996 |
| EP | 0719203 | B1 | 12/1998 |
| JP | 62281990 | A | 12/1987 |
| JP | 0866567 | A | 3/1996 |
| JP | 2005103145 | A | 4/2005 |
| WO | 03/011537 | | 2/2003 |

* cited by examiner

*Primary Examiner* — Clark F Dexter

(57) ABSTRACT

The invention relates to a shaver including a housing and a shaver head. This head includes a bracket, holding a plurality of rotary cutter units, each rotatable around a respective rotation axis. The shaver head also includes a hinge, which is positioned such that during use the bracket can pivot freely with regard to the housing, around a pivot axis that extends substantially perpendicular to the axes of the cutter units.

9 Claims, 3 Drawing Sheets

SHAVER WITH HINGE BETWEEN HOUSING AND SHAVER HEAD

Figure 1A:
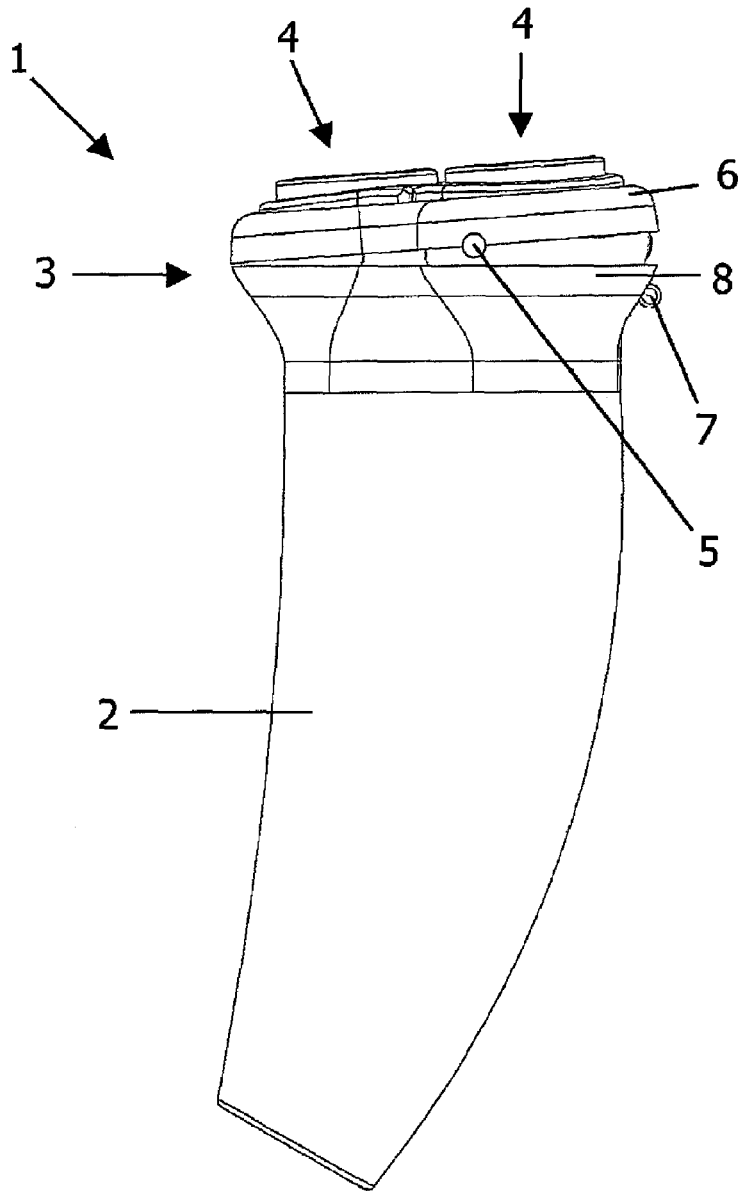

The invention relates to a shaver, more particular an electric shaver, comprising a housing and a shaver head, which shaver head comprises a bracket, the bracket provided with a plurality of rotary cutter units, each rotary cutter unit having a cutter member that is rotatable around a respective rotation axis.

The invention relates to a shaver, more particular an electric shaver, comprising a housing and a shaver head, which shaver head comprises a bracket, provided with a plurality of rotary cutter units, each rotatable around a respective rotation axis.

Such shavers are well known. In use, top surfaces of the rotary cutter units are brought into contact with a user's skin. For optimum contact, at least some of the cutter units may be adjustably mounted in the bracket with one or more degrees of freedom. This allows the individual cutter units to conform their orientation to the contour of a user's skin, which allows the units to remain in close contact with the skin, thereby enabling a close shave. Unfortunately, this adjustability of the units only allows for adjustments on a local, relatively small scale. To follow larger contour variations, the user needs to adapt the orientation of the shaver head by hand. This requires a certain coordination, agility and flexibility, that not all users possess. Moreover, the required manoeuvres may be physically straining, especially for the user's wrist.

In EP721826 it has been already proposed to support the shaver head centrally, on a pivot point. This allows the shaver head to be swivelled in every direction around said pivot point, to adjust for relatively large contour variations. However, with such a swivel configuration, it is rather difficult to accurately shave along a predetermined line or contour, such as for instance is required when shaving along whiskers, a beard, a goatee or a moustache.

It is therefore an object of the present invention to provide a shaver with improved contour following performance, which is suitable both for following relatively large contour variations, independent of a user's shaving skills (at least to a large extent), as well as for performing accurate shaving movements along a predetermined line. To that end a shaver head of a shaver according to the invention is provided with a hinge, positioned such that in operational state the bracket with the cutter units is allowed to pivot with regard to the housing, around a single pivot axis, extending substantially perpendicular to the rotation axes of said rotary units.

Thanks to such pivot axis, the shaver head can readily follow relatively large contour variations, without a user having to twist his arm or wrist in awkward positions. The user can suffice by applying a certain pressure on the shaver head, thereby causing the shaving head or bracket to rotate around said pivot axis and remain in contact with the skin to be shaven.

Preferably, the pivot axis is located closely below a shaving surface as formed by the top surfaces of the respective cutter units. Such location provides for good, direct feedback to a user, assisting him to closely follow the skin contour.

In further elaboration the shaving head may be provided with biasing means, designed to pivot the bracket around the pivot axis into a preferred stationary position with regard to the housing. The biasing means can for instance comprise a series of resilient elements, for instance springs or components made of natural or synthetic rubber, which are located at strategic positions between the housing and the pivoting portion of the shaving head. These resilient elements can be provided with different stiffnesses and/or can be positioned asymmetrically with regard to the pivot axis, so as to urge the bracket towards a specific, preferred position.

The shaver head may furthermore be provided with damping means, designed to dampen pivotal motions of the bracket and prevent sudden movements thereof, thereby contributing to a smooth, comfortable, regular and accurate shaving performance. Of course, the damping means and biasing means can be combined in a single component.

In a highly preferred embodiment, at least some of the rotary cutter units can be suspended in the bracket with at least one degree of freedom, so as to be at least partly depressible and/or rotatable relative to the plane of said bracket. Thanks to such an embodiment, the orientation of all cutter units can be adjusted simultaneously by pivoting the bracket around the pivot axis, thereby allowing relatively large adjustments, in case of relatively large variations in the contour to be shaven. At the same time, the orientation of the cutter units can be adjusted individually, so as to conform to more local, relatively small variations in the shape of a user's skin. As such, the cutter units can remain in good contact with the surface to be shaven, thereby allowing a close shave. Of course, when the cutter units assume such an adapted orientation, their rotation axes may no longer extend exactly perpendicular to the pivot axis of the bracket, or the plane in which said pivot axis extends. This is why, in the main claim, the pivot axis is said to extend "substantially" perpendicular to said rotation axes, wherein the term substantially is meant to include the abovementioned situation with adjusted cutter unit orientation.

In another preferred embodiment, the shaver head or a portion thereof may be detachably hinged to the housing, allowing the shaver head to be flipped open and the cutter units to be cleaned. Furthermore, hairs may be removed from a hair-collecting chamber located in the housing below the shaving head.

To cater for this additional hinge, the shaver head may be provided with a carrier plate, extending between the bracket and the housing. This carrier plate may be detachably connected to the housing, in which case the bracket can be pivotally connected to said carrier plate. With such a configuration, the hinge between the bracket and the carrier plate can remain of relatively simple design, as both components (carrier plate, bracket) need only be connected to the mentioned neighbouring parts via a single hinge line, thereby obviating the need for complicated hinge constructions. Moreover, with such a configuration, the pivot axis can maintain its beneficial position, closely underneath the shaving surface, with the aforementioned advantages (good, direct feedback to the user for accurate contour following). Of course, in an alternative embodiment, the bracket can be detachably connected to the carrier plate and said carrier plate can be pivotally connected to the housing.

Preferably the hinge is positioned such that the pivot axis of the bracket extends substantially perpendicular to a shaving direction of the shaving head during use. In this way, any pivot motion of the bracket around said pivot axis, can replace a twisting movement of a user's wrist. Thus, good contour-following performance can be achieved without a user having to strain his wrist. To ensure that said pivot axis of the bracket will indeed extend substantially parallel to a pivot movement of a user's wrist, the ergonomic design of the housing may be such that the housing will be gripped by a user in a predetermined way.

In further elaboration, driving means for driving the rotary cutter units may be accommodated in a part of the housing that remains stationary when the bracket with the cutter units is pivoted. In this way, these driving means can remain stationary, obviating the need for a complex suspension. Moreover, the number of components and mass participating in said pivoting movement is minimized, which even further facilitates guiding and steering of the shaver head along the surface to be shaven.

Suitable transmission means may be provided between the drive means and the cutter units, to allow a change in orientation of said cutter units with regard to said drive means. For a detailed description of one possible realization of such drive means, reference is made to the international patent application WO 03/011537 of applicant, which application is herein incorporated by reference.

Further advantageous embodiments of a shaver according to the present invention are set forth in the dependent claims.

Figure 2:
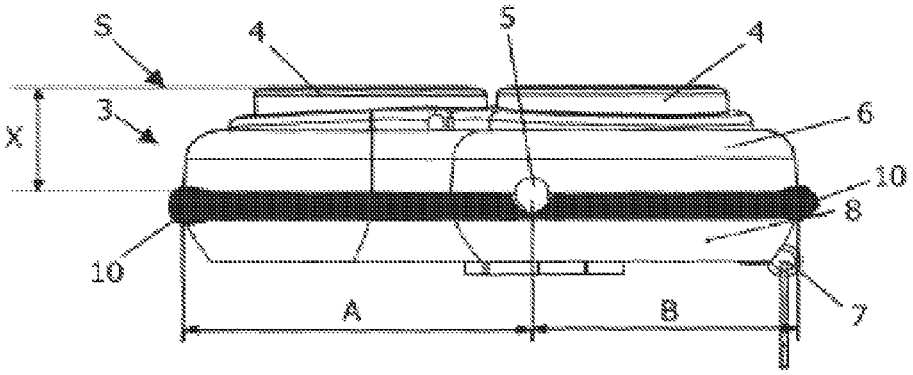

To explain the invention, an exemplary embodiment thereof will hereinafter be described with reference to the accompanying drawings, wherein:

FIGS. 1A,B show in side view and perspective view respectively a shaver according to the invention;

FIG. 2 shows in more detail the shaver head of FIG. 1A; and

Figure 3A:
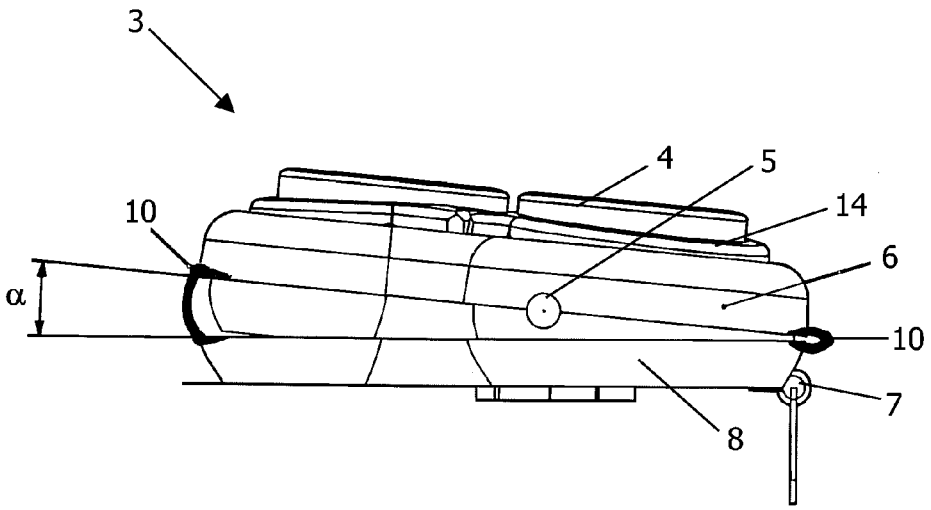

FIGS. 3A,B show the shaver head of FIG. 2 in two canted positions.

In this description, identical or corresponding parts have identical or corresponding reference numerals.

The shaver 1 shown in FIGS. 1A,B comprises a housing 2 and a shaver head 3, which in the given embodiment is provided with three rotary cutter units 4, arranged at the vertices of the equilateral triangle. Of course, in alternative embodiments, the shaver 1 according to the invention can have more or less rotary cutter units 4, which moreover may be disposed in different configurations.

Each cutter unit 4 comprises a cap-shaped outer cutter member 12, with a top surface S that during use is brought into contact with a user's skin, and is provided with hair-entry apertures (not shown) for catching hairs to be shaven. Each cutter unit 4 furthermore comprises an inner cutter member (not shown), which is arranged to be rotated along a bottom side of the outer cutter member 12, around a rotation axis R, so as to cut off any hairs entering the hair-entry apertures. Drive means for rotating said inner cutter members may be accommodated in the housing 2, together with a power source and suitable transmission means. These components may also at least partly protrude into the shaver head 3.

As best seen in FIG. 2, the shaver head 3 according to the invention comprises a bracket 6, in which the rotary cutter units 4 are mounted, and a carrier plate 8, with which the shaver head 3 is connected to the housing 2. The bracket 6 is pivotally connected to the carrier plate 8 via a hinge 5, allowing the bracket 6 to rotate with respect to said carrier plate 8 around a pivot axis C (see FIG. 1B). This pivot axis C extends substantially perpendicular to the rotation axes R of the cutter units 4, at a relatively small distance X below the shaving surface S thereof (see FIG. 2).

The pivot axis C furthermore extends substantially parallel to one side of the equilateral triangle formed by the shaving units 4. Thanks to such orientation of the pivot axis C it is possible, upon rotation of the bracket 6 around said axis C, to have either one shaving unit 4 participate in the shaving action, that is the one unit 4 extending at one side of said pivot axis C, e.g. for small, accurate shaving action, for instance between a nose and mouth, or to have the two shaving units 4 at the other side of said pivot axis C participate in the shaving action, e.g. to shave larger sections, possibly along a straight line.

As furthermore can be seen from FIG. 2, the distance between the pivot axis C and the side of said equilateral triangle is, in the given embodiment, smaller than a distance from said pivot axis C to the opposing vertex of the triangle. More specifically, FIG. 2 shows the distance B between the pivot axis C and the side of the bracket 6 that corresponds to the side of said equilateral triangle is, in the given embodiment, smaller than a distance A from said pivot axis C to the side of the bracket 6 that corresponds to the opposing vertex of the triangle. Such asymmetric location of the pivot axis C enables a shaving pressure, exerted on the shaverhead by a user, to be non-uniformly distributed over the cutter units 4, especially the outer cutter members 12 thereof. This may in some cases be beneficial, for instance when said outer cutter members 12 are of asymmetric design, for instance by featuring an asymmetric pattern of hair-entry apertures, wherein one half of an outer cutter member 12 may be provided with radial slits and the other half may be provided with circular holes, or the like. Of course, in alternative embodiments, the distances A, B may be dimensioned differently or may even be dimensioned equal in size.

Preferably the housing 2 is designed such that during use it will be gripped by a user in a specific way. Moreover, the pivot axis C is preferably oriented with regard to the housing 2 such that when gripped in said preferred way, the pivot axis C extends substantially parallel to a line extending between a user's gripping thumb and his opposing fingers. In this way, said pivot axis C extends substantially parallel to a pivot axis of the user's wrist. Consequently, during use, the orientation of the bracket 6 with the cutter units 4 may be adjusted by a rotation around pivot axis C, instead of a pivotal movement of the user's wrist, which may enhance the ergonomic comfort of the shaver 1.

Figure 3B:
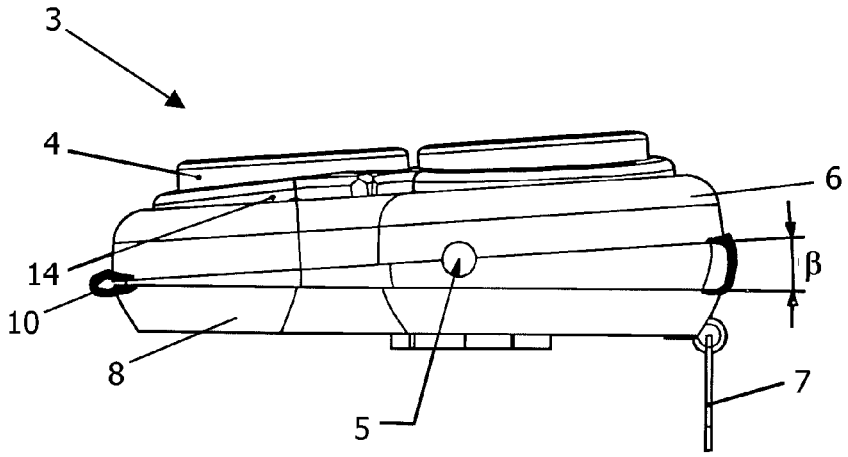

A biasing means 10, which is shown as a cross section in FIGS. 2, 3A, and 3B, may be provided between the carrier plate 8 and bracket 6, to urge the bracket 6 into a desired, neutral position with regard to the carrier plate 8. This neutral position may for instance be a position in which the carrier plate 8 and bracket 6 extend approximately parallel to each other, as illustrated in FIG. 2. Alternatively, such a neutral position may be a position in which the carrier plate 8 and the bracket 6 include a certain angle .alpha., .beta., as shown in FIGS. 3A and 3B. The biasing means 10 may furthermore act as damping means, to provide a certain resistance against rotation of the bracket 6 and to smoothen any such rotating motion. The biasing means 10 may for instance comprise a series of strips, positioned at strategic locations between the circumferential edge of the carrier plate 8 and the bracket 6, or a continuous band surrounding said plate 8 and bracket 6. Said strips or band can be made of a resilient, elastic material, such as for instance natural or synthetic rubber, plastic or the like. Of course, alternative embodiments are possible, wherein the biasing means 10 can for instance comprise spring elements made of metal or plastic.

Figure 1B:
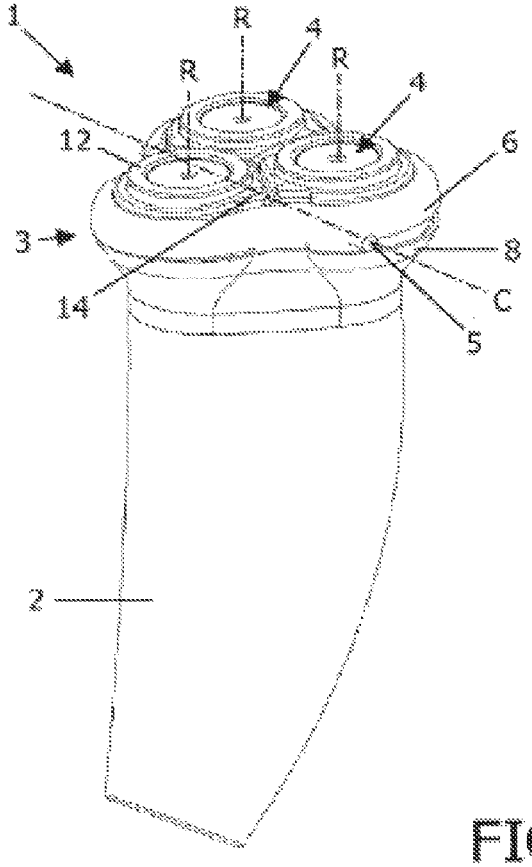

In a preferred embodiment, the cutter units 4 can be adjustably mounted in the bracket 6, for instance by means of three mounting plates 14, as illustrated in FIG. 1B. These mounting plates 14 can be pivotally suspended in the bracket 6, thereby allowing the individual cutter units 4 to be pressed or rotated inward, so as to adapt the mutual orientation of their top surfaces. Consequently, the shaving surface S of the shaver head 3, as formed by the top surfaces of said cutter units 4, can take on a configuration that substantially corresponds to the contour of a user's skin. For a more detailed description of the mounting principle of said cutter units 4, reference is made to European patent application EP 0 719 203 of applicant, the contents of which are herein incorporated by reference.

In a further preferred embodiment, the housing 2 may accommodate a hair collecting chamber (not shown), situated just below the shaver head 3, to collect cut off hair stubs during use. To clean this chamber and/or the cutter units 4, the shaver head 3 is detachably connected to the housing 2 via a second hinge 7, which in the given embodiment is mounted between the carrier plate 8 and the housing 2, as best seen in FIGS. 1A and 2. In an alternative embodiment (not shown), the second hinge 7 could be located between the carrier plate 8 and the bracket 6. In such case, the first hinge 5 and the biasing means 10 may (but need not necessarily) be shifted to a location between the carrier plate 8 and the housing 2. Of course, the shaver head 3 can also be made to be completely detachable from the housing 2.

FIGS. 3A and B show two extreme positions of a shaver head 3 according to the invention, wherein the bracket 6 is pivoted clockwise and counter clockwise, respectively, around pivot axis C, thereby causing the bracket 6 to include a pivot angle $\alpha$ and $\beta$, respectively, with the carrier plate 8. As such, the orientation of the shaving surface S of the cutter units 4 can be adjusted to the contour of a user's skin, without the user having to bend his hand or wrist in unnatural positions. As can be seen from these figures, the pivoting movement causes the biasing means 10 at one side of the shaver head 3 to be compressed and at the opposite side to be stretched, which will cause said biasing means 10 to impart a reaction force on the bracket 6, which tends to urge the bracket 6 back into its neutral position as shown in FIG. 2 (which, as mentioned before, does not necessarily have to be a position wherein the pivot angles $\alpha$, $\beta$ are zero). Furthermore, from FIGS. 3A,B it can be seen that the maximum pivot angles $\alpha$, $\beta$ of the bracket 6 do not need to be the same for pivotal movements in different directions. For instance, in the given example, angle $\alpha$ is clearly larger than angle $\beta$, which of course is the direct result of the pivot axis C being located off centre.

Blocking or latching means (not shown) may be provided to lock the bracket 6 in a preferred position, for instance one of the positions shown in FIG. 2 or FIGS. 3A,B.

The invention is not in any way limited to the exemplary embodiments presented in the description and drawing. All combinations (of parts) of the embodiments shown and described in this description are explicitly understood to be incorporated within this description and are explicitly understood to fall within the scope of the invention. Moreover, many variations are possible within the scope of the invention, as outlined by the claims.

It is noted that in embodiments wherein the shaver can be flipped open, the expression "operational state" of the bracket indicates the closed state of the shaver head. However, the invention also covers embodiments in which the shaver head cannot be flipped open so that the bracket is always in its operational state.

The invention claimed is:

1. A shaver comprising a housing and a shaver head that is attached to the housing, said shaver head comprising:

a bracket holding a plurality of rotary cutter units at a top side of the bracket, wherein each of the rotary cutter units includes a cutter member that is rotatable around a respective rotation axis, and the bracket includes a central axis that extends through a center of the bracket and is substantially parallel to the rotation axes;

a carrier plate;

a biasing means that is a continuous band surrounding an area between the carrier plate and the bracket, the biasing means being attached to the carrier plate along a lower edge of the biasing means and being further attached to the bracket along an upper edge of the biasing means; and a first hinge disposed on a lateral side of the bracket, wherein the lateral side extends away from the top side in a direction towards the carrier plate, wherein the first hinge attaches the bracket to the carrier plate about a pivot axis such that the bracket and the carrier plate are pivotable relative to one another about only the pivot axis, and wherein the pivot axis extends substantially perpendicular to the rotation axes of the cutter members of the rotary cutter units, the pivot axis being laterally offset such that it extends between two of the rotation axes while avoiding passage through the central axis of the bracket.

2. A shaver according to claim 1, wherein the biasing means biases the bracket into a predetermined neutral position.

3. A shaver according to claim 1, wherein at least some of the rotary cutter units are suspended in the bracket with at least one degree of freedom.

4. A shaver according to claim 1, wherein the shaver head is detachably connected to the housing.

5. A shaver according to claim 1, wherein the carrier plate is detachably connected to the housing via a second hinge.

6. The shaver according to claim 1, wherein the shaver head comprises three of said rotary cutter units, arranged at the vertices of a triangle, and wherein the pivot axis extends substantially parallel to a first side of the sides of said triangle.

7. The shaver according to claim 6, wherein the triangle is an equilateral triangle.

8. The shaver according to claim 6, wherein the pivot axis is closer to the first side of the triangle than the pivot axis is to a vertex of the triangle opposite the first side.

9. A shaver comprising a housing and a shaver head that is attached to the housing, said shaver head comprising:

a bracket holding a plurality of rotary cutter units, wherein each of the rotary cutter units includes a cutter member that is rotatable around a respective rotation axis, and the bracket includes a central axis that extends through a center of the bracket and is substantially parallel to the rotation axes;

a carrier plate;

a band surrounding an area between the carrier plate and the bracket, the band being attached to the carrier plate and the bracket; and a hinge pivotally connecting the carrier plate to the bracket allowing the bracket to rotate with respect to the carrier plate around a pivot axis such that the carrier plate and the bracket are pivotable relative to one another about only the pivot axis, wherein the pivot axis extends substantially perpendicular to the rotation axes of the cutter members of the plurality of rotary cutter units, the pivot axis being laterally offset such that it extends through the hinge and between two of the rotation axes while avoiding passage through the central axis of the bracket.

* * * * *